United States Patent [19]

Clendening, Jr. et al.

[11] 4,259,768

[45] Apr. 7, 1981

[54] YARN TEXTURING JET

[75] Inventors: Frank J. Clendening, Jr.; Elva L. Rose, both of Wilmington, Del.

[73] Assignee: E. I. Du Pont de Nemours and Company, Wilmington, Del.

[21] Appl. No.: 116,919

[22] Filed: Jan. 30, 1980

[51] Int. Cl.[3] ..... D02G 1/16

[52] U.S. Cl. ..... 28/254; 28/272; 28/273

[58] Field of Search ..... 28/254, 272, 273

[56] References Cited

U.S. PATENT DOCUMENTS

| | | |
|---|---|---|
| 2,783,609 | 3/1957 | Breen . |
| 3,402,446 | 9/1968 | Benson . |
| 3,545,057 | 12/1970 | Lubach . |
| 3,577,614 | 5/1971 | Price . |
| 4,157,605 | 6/1979 | Agers . |

*Primary Examiner*—Robert Mackey

[57] ABSTRACT

A self-stringing jet device which is compact and easy to string up includes a body, a yarn inlet section, and a movable venturi and a rotatable cylindrical baffle located at the outlet end of the jet. The yarn inlet section comprises a cone-shaped yarn entrance having an axis that is at an angle with the axis of the yarn passage through the jet. The venturi may be moved from a stringup position to an operating position by one or more camming surfaces on the rotatable cylindrical baffle.

2 Claims, 3 Drawing Figures

YARN TEXTURING JET

BACKGROUND OF THE INVENTION

The invention relates to air texturing of yarn and more particularly, to improvements in a fluid jet apparatus used to texture the yarn.

One preferred type of jet for air texturing continous filament yarns is known from Lubach U.S. Pat. No. 3,545,057 wherein high pressure texturing fluid enters a chamber surrounding the forward end of a yarn needle through an orifice or recess parallel to the axis of the yarn needle. The further benefits of employing a baffle at the exit of such a jet in conjunction with a preferred distance from the exit of the fluid orifice to the forward end of the yarn needle is known from Agers U.S. Pat. No. 4,157,605. The use of conical yarn inlets is known from Breen U.S. Pat. No. 2,783,609 (FIG. 8) and Benson U.S. Pat. No. 3,402,446, the latter also disclosing the use of such entrances for reduction of damage to yarn entering the jet from blowback of air out of the yarn needle in the direction opposite the yarn movement. In addition to the above, Price U.S. Pat. No. 3,577,614 discloses a venturi located at the outlet end of the jet which is movable between a preset operating position and a preset stringup position.

SUMMARY OF THE INVENTION

A more compact jet device has now been found which is easier to string up than the above noted jets. This jet device includes a body having yarn inlet and outlet ends connected by a central bore, means for introducing pressurized gas through a gas inlet into said bore, a venturi located in said bore at the outlet end of the jet, a yarn guiding element extending into the bore from the yarn inlet end of the jet, the yarn guiding element having a passage through it for guiding yarn from the yarn inlet to the venturi, and a cylindrical baffle located at the outlet end of the jet. The baffle is positioned by and rotatable in a bracket attached to the outlet end of the jet. The yarn inlet section has successive cone-shaped, cylindrical and conical lengths leading to the passage in the yarn guiding element. The cylindrical and conical lengths are coaxial with the yarn passage in the guiding element while the axis of the cone-shaped length is at an angle with the axis of the passage through the yarn guiding element. The venturi is axially slidable in the body from a preset operating position to a stringup position back to a preset operating position and is attached to a flange located outside the body at the outlet end of the body. Means which may be in the form of camming surfaces attached to the rotatable baffle and engaging said flange are used to position the venturi in the stringup or operating positions depending on the rotational position of the baffle.

DETAILED DESCRIPTION OF THE PREFERRED EMBODIMENT

Figure 1:
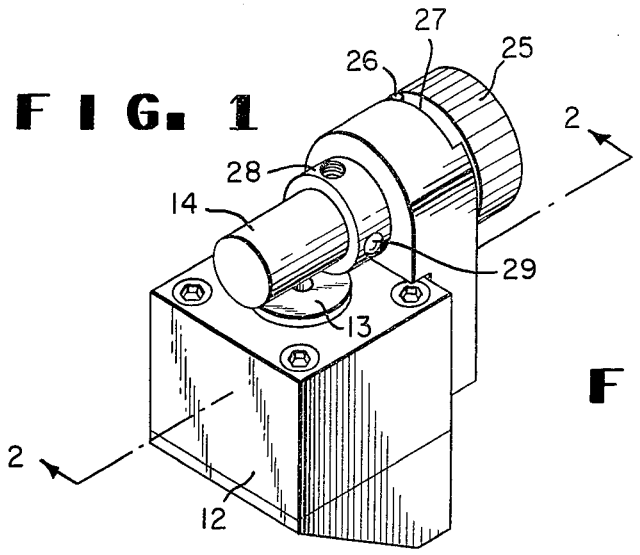
FIG. 1 is a perspective view of a preferred embodiment of the invention.

Referring to the drawing, the major elements of the jet device are yarn inlet section 10, body 12, movable venturi 13 and rotatable baffle 14 with its supporting bracket 15 attached to body 12. Yarn inlet passage section 10 comprises cone-shaped length 16, the axis of which is at an angle of the axis to yarn passage 17. Connecting cone-shaped length 16 with yarn passage 17 is an intermediate cylindrical length 18 and an intermediate conical length 19. The outer portion of this yarn guiding element comprises a cylindrical portion 20 with a conical tip 21. Fluid orifice 22 has its axis parallel to the axis of yarn passage 17 and is supplied with fluid such as compressed air through fluid connection 23.

Rotatable cylindrical baffle 14 is turned by handle 25, the movement being limited by pin 26 in slot 27 of bracket 15 to approximately 90° rotation. Cam 28 is fixed to rotatable cylindrical baffle 14 and has two adjustable cam surfaces 29 and 30 which may be set screws. One of the set screws is in contact with the flange of the movable venturi 13 at each end of the permissable rotation of cylindrical baffle 14, one screw being adjusted to hold movable venturi 13 close to conical tip 21 during stringup so that only a small amount of air flows between the two and the other screw being adjusted to hold the venturi at a position farther away from conical tip 21 for optimum texturing action when in operating position.

The operation of this device is as follows: when a yarn or yarns are to be strung up, handle 25 is turned so that movable venturi 13 is moved toward conical tip 21 thus restricting the flow of air until ambient air is aspirated through yarn inlet section 10 into and through throat 35 of movable venturi 13. The operator then inserts yarn into the cone-shaped length 16 where the aspirated air assists in carrying the yarn through venturi throat 35 to the outlet end. The operator then rotates handle 25 to the opposite position so that the movable venturi 13 is allowed to move farther away from conical tip 21 under the force of the air pressure within the jet. In this operation position, air flows from orifice 22 into and through fluid chamber 36 surrounding cylindrical section 20 and into the converging entrance of movable venturi 13.

The included angle of cone-shaped length 16 should be as large as possible to allow the operator's fingers to guide the yarn as closely as possible into yarn passage 17, the distance from the apex of the cone to the forward end of conical tip 21 being as small as possible. The diameter of cylindrical section 18 may preferably be large to facilitate stringup and reduce adverse effects of air blowback on the yarn when the jet is in operating position.

The axis of cone-shaped length 16 is at an angle to the axis of yarn passage 17 to provide space for air orifice 22 and fluid inlet 23 and still have a large enough conical entrance to accommodate the operator's fingers. End surface 40 of yarn inlet section 10 may be cut at an angle as shown in the drawing to further reduce the length of the device toward greater compactness and to allow the operator's fingers to get still closer to yarn passage 17.

Yarn inlet section 10 may be made still shorter and more compact if fluid inlet connection 23 is moved to other locations, but the minimum length of air orifice 22 should be at least 5 air passage diameters and preferably at least 7 air passage diameters. Air should enter air orifice 22 from a chamber subtantially larger than the air orifice.

The distance from the exit of the air orifice 22 to the forward end of conical tip 21 is preferably 0.375 to 0.65 inches as described in Agers U.S. Pat. No. 4,157,605.

Yarn inlet section 10 may be secured to body 12 by screws or screw threads, or alternatively yarn inlet section 10 and body 12 may be made as a single piece.

Instead of using rotatable baffle 14 to operate movable venturi 13, the venturi may be arranged as shown in Price U.S. Pat. No. 3,577,614 and a fixed cylindrical or other type baffle may be attached by conventional mounting means.

Figure 3:
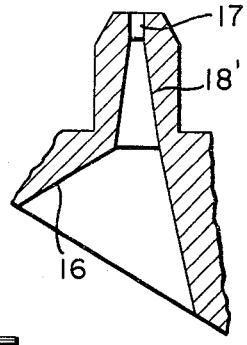
FIG. 3 is an enlarged partial section view of an alternate arrangement for the yarn passage of FIG. 2.
Figure 2:
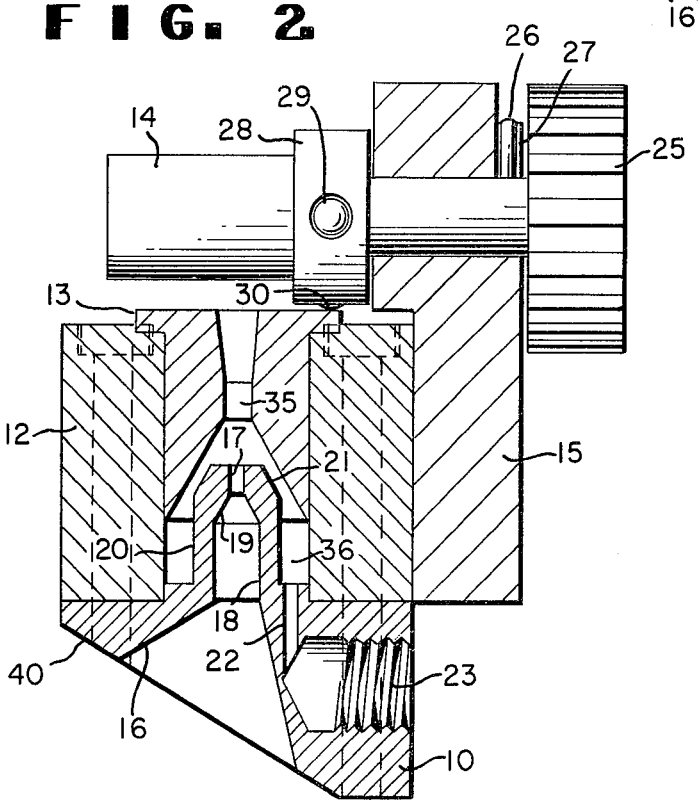
FIG. 2 is an enlarged section view of FIG. 1 taken along line 2—2.

While the preferred embodiments disclose intermediate lengths of the yarn passage as cylindrical and conical, these parts of the passage could be completely conical and work just as well. For example FIG. 3 shows the intermediate length between the cone-shaped length 16 and the yarn passage 17 to be a cone-shaped length 18'.

We claim:

1. In a yarn texturing jet including a body having yarn inlet and outlet ends connected by a central bore, means for introducing pressurized gas through a gas inlet into said bore, a venturi located in said bore at said outlet end, a yarn guiding element extending into said bore from the yarn inlet end of the body, said yarn guiding element having a passage therethrough for guiding yarn from the yarn inlet to the venturi and a cylindrial baffle located adjacent the outlet end of the jet, said baffle being rotatable in a bracket attached to said outlet end, the improvement comprising: said yarn inlet section having successive cone-shaped and intermediate lengths leading to said passage, said intermediate length being coaxial with said passage, the axis of said cone-shaped length being at an angle to said passage; said venturi being axially slidable in said body from a preset operating position to a stringup position back to a preset operating position and being attached to a flange located outside the body at the outlet end of the body, and means attached to said rotatable baffle and engaging said flange for maintaining said venturi in said stringup position or said operating position depending on the rotational position of said baffle.

2. The jet as defined in claim 1 said means for maintaining said venturi in said stringup or said operating position being camming surfaces on said rotatable baffle that engage said flange.

* * * * *